US005161789A

United States Patent [19]

Rogers

[11] Patent Number: 5,161,789

[45] Date of Patent: Nov. 10, 1992

[54] UNIVERSAL CLAMPING DEVICE

[76] Inventor: Winston L. Rogers, P.O. Box 1066, Friday Harbor, Wash. 98250

[21] Appl. No.: 749,901

[22] Filed: Aug. 27, 1991

[51] Int. Cl.[5] ..... B25B 1/20

[52] U.S. Cl. ..... 269/42; 269/108; 269/109

[58] Field of Search ..... 269/41, 42, 108, 109, 269/130–132

[56] References Cited

U.S. PATENT DOCUMENTS 3,224,754 12/1965 Graham ..... 269/108
3,610,612 10/1971 Day ..... 269/109
4,047,710 9/1977 Wilson ..... 269/42
4,527,784 7/1984 Schwab ..... 269/42
4,560,153 12/1985 Han ..... 269/108

FOREIGN PATENT DOCUMENTS 717381 10/1931 France ..... 269/108

*Primary Examiner*—Robert C. Watson
*Attorney, Agent, or Firm*—Jensen & Puntigam

[57] ABSTRACT

A universal clamping device for use in woodworking or other fabricating projects including a plurality of corner pieces including means to accept clamping straps, guiding dowels and accessories permitting the easy clamping of a variety of shapes and creating clamping pressure in a wide variety of directions and in multiple directions simultaneously.

3 Claims, 4 Drawing Sheets

FIG. 2
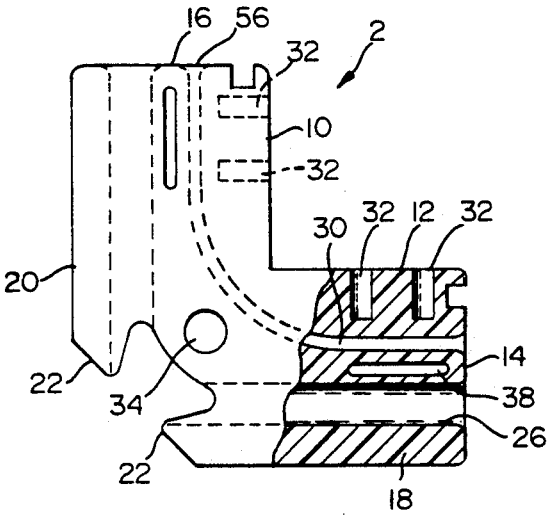
FIG. 3
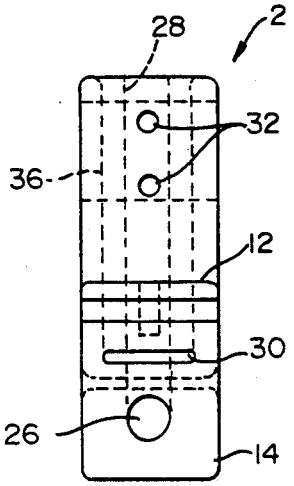
FIG. 4
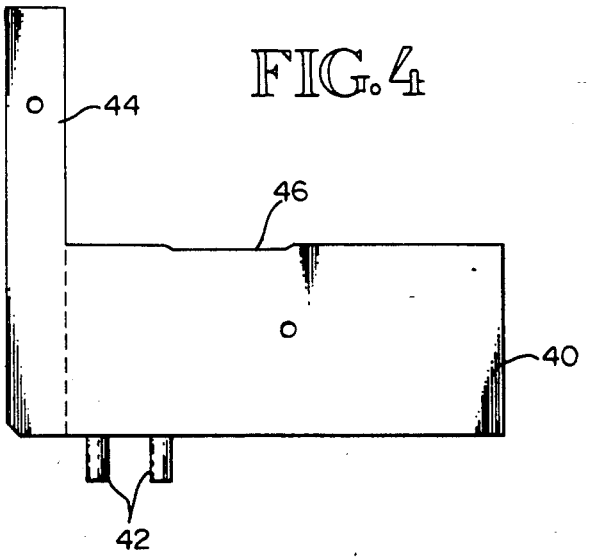
FIG. 5
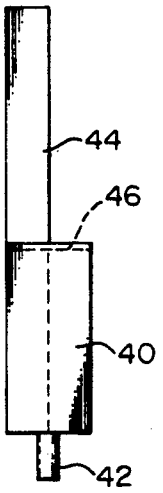
FIG. 6
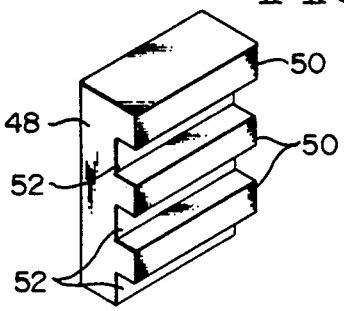
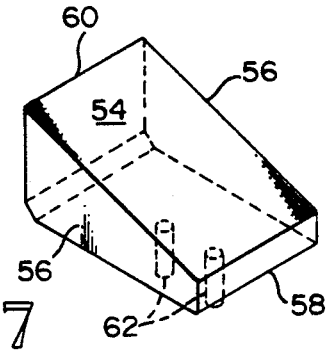
FIG. 7

UNIVERSAL CLAMPING DEVICE

TECHNICAL FIELD

This invention relates to a clamping device and more particularly to a clamping device which has universal application for woodworking in that it is fabricated of a plurality of identical corner pieces each including multiple slots to receive tightening straps and multiple bores to receive dowels for the purpose of aligning the corner pieces or for securing the corner pieces at a predetermined relative position.

BACKGROUND ART

The clamping of elements from which a piece of furniture or the like is fabricated to hold them in the appropriate relative position while waiting for the glue to dry or, in the alternative, holding them in the appropriate relative position for securement by other fastener means has been an ongoing problem.

Numerous jigs and/or clamping devices have been fabricated to hopefully enable a single individual to secure a multi-sided or multi-pieced piece of furniture for the final fabrication. These devices have been cumbersome and in general both expensive and awkward to use.

Prior art devices known to the present inventor which disclose clamping devices include U.S. Pat. No. 875,219 granted to Scammell, Dec. 31, 1907, which discloses a clamping device for building structures wherein identical corner pieces are linked into a unit by threaded members.

U.S. Pat. No. 1,162,759 granted to Ferris, Dec. 7, 1915, discloses gluing clamps including a rigid frame member having adjustable upwardly extending dowel members upon which are placed a horizontal clamping member whereby several parts may be simultaneously clamped and a variety of clamping configurations may be achieved.

U.S. Pat. No. 2,355,603 granted to Zern, Aug. 8, 1944, discloses a woodworking apparatus in the form of an adjustable clamping device secured to a templet to facilitate the location of hinge recesses, keeper plate recesses and the like.

U.S. Pat. No. 2,753,902 granted to Klee, Jul. 10, 1956, discloses a screw actuated clamp having a rectangular framework wherein identical corner pieces are secured together by adjustable rigid threaded elements.

U.S. Pat. No. 3,103,353 granted to Lassy, Sep. 10, 1963, discloses a clamping device primarily for holding a plurality of work pieces for simultaneous working upon same by a tool or the like.

U.S. Pat. No. 3,392,972 granted to Wing, Jul. 16, 1968, discloses a molding cutting and fitting jig comprising rectangular elements which are adjustable in terms of length and may be secured in position securing the work piece once the appropriate size has been determined.

U.S. Pat. No. 3,980,287 granted to Nilsson, Sep. 14, 1976, discloses a combination clamping device and work holder for holding and performing operations upon objects of various different sizes.

U.S. Pat. No. 4,047,710 granted to Wilson, Sep. 13, 1977, discloses a framing form and clamp which includes a fixed corner block member and a plurality of adjustable members which are located in track-like devices located in the supporting surface, the entire unit being compressed by an adjustable strap means.

U.S. Pat. No. 4,125,251 granted to Jamieson, Jr., on Nov. 14, 1978, discloses a universal clamping system wherein a work piece is supported between at least two opposing faces and includes a plurality of junction blocks having smooth walled bores for adjustable positioning along the threaded clamping rods.

U.S. Pat. No. 4,711,436 granted to Kobuck et al, Dec. 8, 1987, discloses a grid assembly fixture which includes a plurality of bars which are hinged together along one end of each pair and locked into position at the opposite end.

DISCLOSURE OF THE INVENTION

With the above-noted prior art and problems in mind, it is an object of the present invention to provide a clamping system which is simple to use, has a minimum number of parts, and the adjustments to the size and location of the elements may be quickly made.

It is another object of the present invention to provide a clamping system which includes a plurality of identical clamping corner blocks which may be used in any one of a variety of positions lending to the universality of application.

It is still a further object of the present invention to provide a plurality of identical corner clamping blocks wherein the blocks may be linked together by either dowels passing through any one of a variety of provided bore and by clamping straps which may be likewise passed through any one of a plurality of provided slots further attributing to the universality.

It is still a further object of the present invention to provide a clamping system wherein the primary clamping element is a plurality of clamping corner blocks linked by a clamping strap but the system is also provided with the means to supplementary additional clamping by means of a rigid clamping device extending diagonally of the primary clamping means.

Yet anther object of the present invention is to provide a universal clamping means wherein the face of the clamping blocks is provided with closed holes or bores to receive outwardly extending pegs on any one of a plurality of attachments which modify and specialize the clamping device itself.

Still a further object of the present invention is to provide a plurality of universal clamping blocks including means such that they may be individually located and spaced such that a complex clamping operation may be done by a single individual.

BRIEF DESCRIPTION OF THE DRAWINGS

FIG. 2 is a partial sectional elevational view of the corner block of the clamp illustrating the structure showing the means for securing and locating the device during operation.

FIG. 3 is an end elevational view of the block member of FIG. 2.

FIG. 4 is a side elevation of one of the accessory items used with the clamp of FIGS. 2 and 3 used primarily for edge gluing or plywood edging.

FIG. 5 is an end view of the accessory of FIG. 4.

FIG. 6 is an isometric of the accessory device used for mortise and tenon gluing a box joint or the like.

FIG. 7 is an isometric view of the accessory used for clamping objects with more than four corners.

BEST MODE FOR CARRYING OUT THE INVENTION

Figure 1:
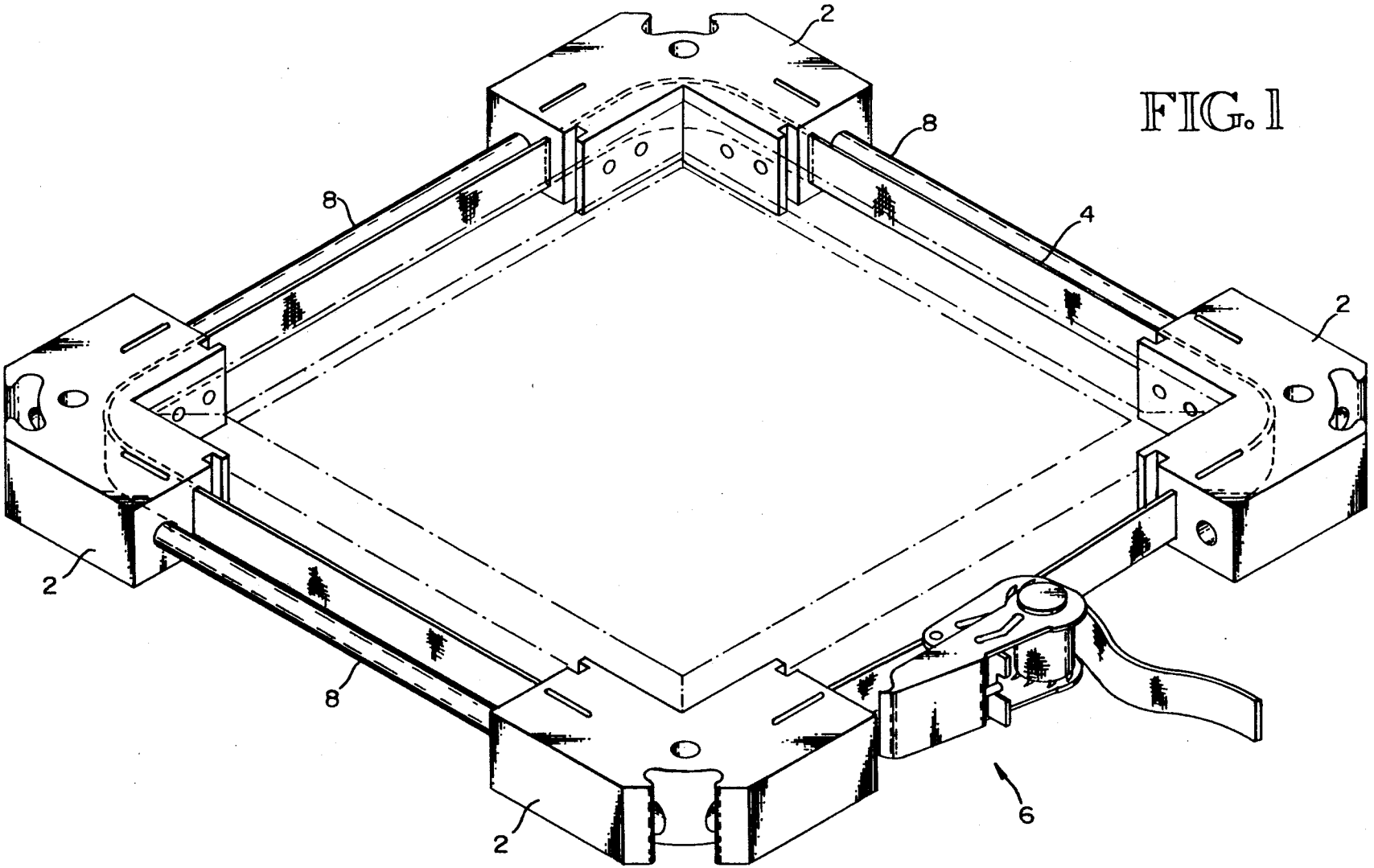
FIG. 1 is an isometric illustration showing the utilization of the inventive clamping block for securing a frame means having mitered corners.

As seen in FIG. 1, the present invention when used for clamping a picture frame or the like comprises four identical corner blocks 2, to be described in greater detail hereinafter, interconnected by a tightening strap 4 which is passed through a channel in each of the blocks such that the strap portions on opposite sides of the block are perpendicular and the strap is terminated with a rachet-type tightening and securing device 6. Further noted in this view are the plurality of dowels 8 which extend between each of the corner blocks on the three sides not including the rachet-securement device, and these dowels assist in keeping the corner blocks in relative square alignment to assure that the clamping is likewise done in a square fashion.

As indicated hereinabove, the inventive device is shown illustratively clamping a rectangular frame and, as can be readily seen, clamping may be quickly and easily done since each of the corners may be placed adjacent the appropriate corner of the framework with the strap already passing therethrough, the strap pulled tight, latched, and the appropriate tension then placed thereupon securing the frame as needed.

Reference is now had to FIG. 2 which more clearly illustrates the interior configuration of each of the corner blocks. As can be seen in this view, the corner block is fabricated of a solid piece of material having interior surfaces 10 at right angles to each other for engagement with the work piece, includes flat end pieces 14 and 16 perpendicular to the faces 10, 12 and exterior surfaces 18, 20, substantially parallel to the interior faces 10, 12. Exterior surfaces 18, 20 do not intersect but are joined by a truncated corner having angular outer edges 22 which define a recessed center portion 24 which is set at approximately 45° to the exterior surfaces 18, 20 and has a slightly outwardly curved portion to accommodate the face of a rigid clamp which could be set diagonally from corner to corner to assist in assuring that the device being clamped is square.

Likewise seen in this view is a pair of smooth-sided dowel receiving bores 26, 28, a through slot 30 which is rectangular in cross-section and extends from face 14 through the corner section to face 16 to receive the primary securement strap.

Likewise seen in this view are a plurality of closed ended bores 32, two on each of the faces 10, 12, for receiving attachments as described hereinafter. A transverse bore 34 and transverse slots 36, 38 are provided to accommodate supplementary straps and/or dowels which are placed in planes parallel to faces 10, 12 or perpendicular to the primary binding strap which extends through slot 30.

Reference is now had to FIG. 3 which is a vertical end view of the corner block of FIG. 2 where the interrelationship of some of the various parts may more easily be seen. Identical numbers identify identical portions in each of the views.

FIGS. 4 and 5 disclose an accessory unit for use in conjunction with the corner block as shown in FIGS. 2 and 3 and includes a relatively thick base portion 40 including a pair of outwardly projecting dowels 42 for interrelationship with the bores 32 in the corner block 2 and an upwardly projecting perpendicular leg 44 which, as seen in FIG. 5, is one-half the thickness of the base portion 40 such that when used in pairs, the portions 44 may slide by each other, allowing the relative elements 40 to be placed the appropriate distance apart to conform to the device being clamped. It is to be noted in this view that there is a flat depressed area 46 in the base member 40 which is to accommodate the wider strip of solid wood which is used for end-finishing plywood. A piece of filler material, slightly crowned, not shown, is placed between element 44 and the edge to be clamped such that the pressure is uniform throughout the width of the finished piece.

FIG. 6 discloses a box joint clamp which includes a base portion 48 having outwardly extending ridges 50 separated by complimentary grooves 52 such that box joints may be clamped from two directions.

The accessory seen in FIG. 7 includes a truncated triangularly shaped solid piece having angled face member 54, parallel side members 56, bottom member 58 and a rear member 60 such that bottom member 58 and rear member 60 are perpendicular and fit into the intersection between faces 10 and 12 with the dowels 62 being inserted in the closed openings 32 in faces 10 and 12 such that the clamping member will place a uniform clamping pressure on an object which is not rectangular, in this case, octagonal.

Figure 8:
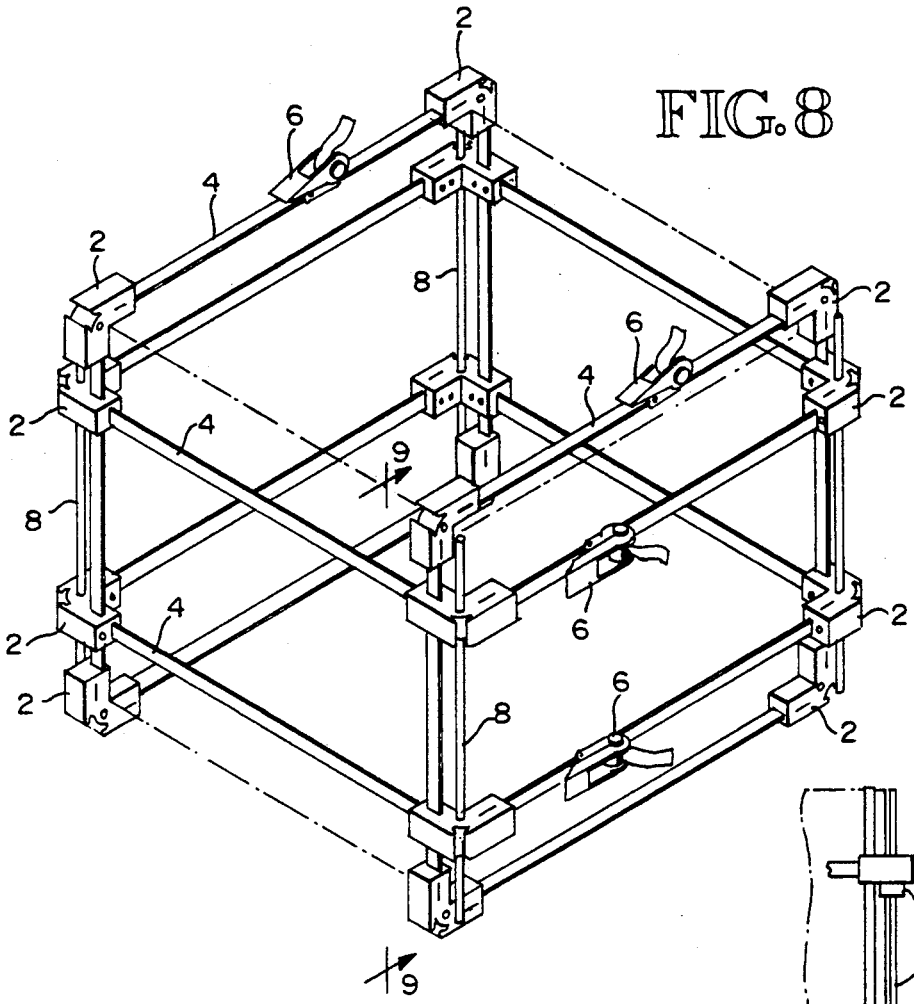
FIG. 8 is an isometric view of the utilization of a plurality of the inventive clamping means for securing a block or box.

Reference is now had to FIG. 8 wherein the inventing clamping mechanism is used in conjunction with the complete clamp of a rectangular object such as a box. As seen in this view, there are two sets of clamping corner blocks 2 with the corner blocks placed in a horizontal configuration with one of the sets about the lower portion of the box and the other set about the upper portion of the box. As explained hereinafter, the clamping blocks 2 are located and secured in position along vertical dowel member 8 by stopping means. Likewise seen in this view is the fact that horizontal dowel members 8 are used along all of the sides with the exception of the side wherein the clamping tightening member 6 is located. In a situation such as when the side elements of the box member are in fact themselves edge-glued for water tightness or the like, a second pair of set of corner blocks are used at the upper corners with straps 4 extending in the previously described fashion with respect to the second set and through the horizontal grooves in the first set. Thus, as can be seen, the box is secured in all directions, and the operation which may be quickly and easily done by a single person.

Figure 9:
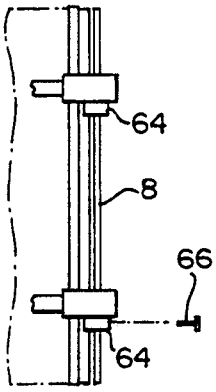
FIG. 9 is a vertical section along lines 9—9 of FIG. 8.

FIG. 9 depicts an elevational view along lines 9,9 of FIG. 8, and as can be seen in this view, there are provided a plurality of collar members 64 along the doweled member 8 including pins or threaded devices 66 such that these members may be fixedly located along the dowel to assist in the clamping process.

Figure 10:
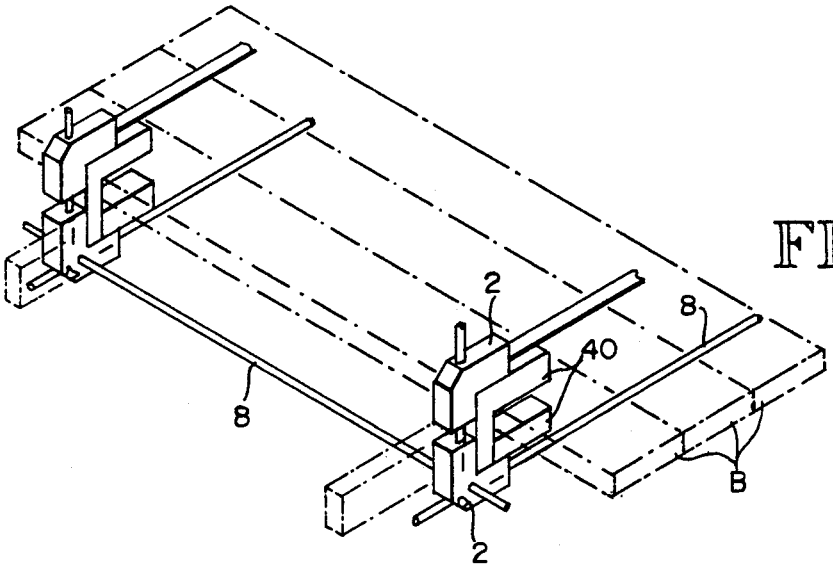
FIG. 10 is an isometric displaying the device in use for edge gluing.

FIG. 10 discloses the utilization of the inventive device for edge-gluing boards. It is to be noted that is used in conjunction with parallel two-by-three support members designated upon which the board which are to be edge-glued without the benefit of doweling are placed in a side-by-side position. Corner blocks 2 are used in pairs along opposite edges of the boards to be glued and the edging accessory is placed in position with the base or thicker leg 46 in the vertical position. Dowels 8 extending through the bores in the corner blocks 2 are utilized to help assure that the devices are square and the straps are applied in the fashion previously and the device is retained in its clamped position until the glue has had an opportunity to set.

Figure 11:
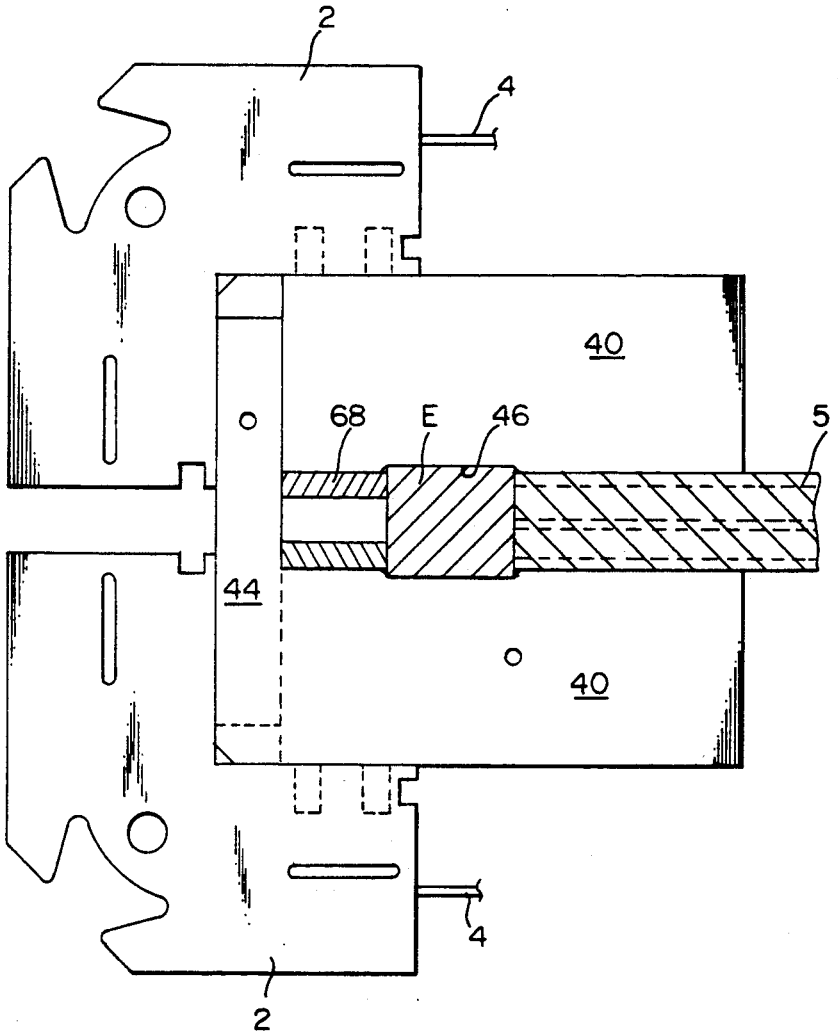
FIG. 11 is a vertical section showing the inventive device utilized for edge-finishing of a piece of plywood.

FIG. 11 depicts the utilization of the inventive clamping member in securing an edge to a piece of plywood and it is used in a similar manner to edge-gluing with the exception of the fact that the edge-gluing accessory is turned 90° and a spacer or filler member 68 is used to assure uniform pressure throughout the width of the plywood member and the groove 46 accommodates the slightly thicker wood that is used to cover the edge of the plywood and then is trimmed to size.

Thus, as can be seen the present invention contemplates a relatively inexpensive easy-to-use clamping device which allows a single individual to effectively clamp objects of several different configurations without the necessity of additional jigs and/or sets of hands.

I claim:

1. A clamp element to be used in conjunction with three or more similar elements interconnected with at least one adjustable strap comprising:

a relatively thick main body portion of an L configuration wherein the legs are the same length and have a substantially uniplanar inner surface, each leg including a longitudinal bore extending the length thereof along the exterior edge and a longitudinal, substantially rectangular slot which slots intersect in a smooth interior arcuate intersection, each leg also including a substantially rectangular slot extending through the leg laterally thereof, said main body portion further including a lateral bore at the intersection of the legs whereby a plurality of elements may be aligned in a three-dimensional array by dowels extending through the bores thereof, said elements likewise being capable of presenting clamping forces in a three-dimensional configuration whereby the device may readily and easily be used to clamp objects in either two or three dimensions.

2. A clamp means as in claim 1 wherein the element further includes bores on the inner face of the leg to accept accessory clamp means altering the inner surface of the legs.

3. A clamp means as in claim 1, and further including a surface at approximately 45° to each of the legs at the outer edge of the intersection of the legs to accept auxiliary clamp means.

* * * * *